US007825598B2

(12) United States Patent
Smith et al.

(10) Patent No.: US 7,825,598 B2
(45) Date of Patent: Nov. 2, 2010

(54) MERCURY-FREE DISCHARGE COMPOSITIONS AND LAMPS INCORPORATING TITANIUM, ZIRCONIUM, AND HAFNIUM

(75) Inventors: David John Smith, Clifton Park, NY (US); Joseph Darryl Michael, Schoharie, NY (US); Timothy John Sommerer, Ballston Spa, NY (US)

(73) Assignee: General Electric Company, Niskayuna, NY (US)

( * ) Notice: Subject to any disclaimer, the term of this patent is extended or adjusted under 35 U.S.C. 154(b) by 895 days.

(21) Appl. No.: 11/638,913

(22) Filed: Dec. 14, 2006

(65) Prior Publication Data

US 2007/0096656 A1 May 3, 2007

Related U.S. Application Data

(63) Continuation-in-part of application No. 11/015,636, filed on Dec. 20, 2004.

(51) Int. Cl.
*H01J 61/12* (2006.01)
*H01J 61/18* (2006.01)

(52) U.S. Cl. ..... 313/637; 313/638; 313/567

(58) Field of Classification Search ..... None
See application file for complete search history.

(56) References Cited

U.S. PATENT DOCUMENTS

| | | | | |
|---|---|---|---|---|
| 2,765,416 A | | 10/1956 | Beese et al. | |
| 5,504,392 A | * | 4/1996 | Natour et al. | 313/570 |
| 5,844,365 A | * | 12/1998 | Natour | 313/633 |
| 5,866,984 A | * | 2/1999 | Doughty et al. | 313/643 |
| 5,889,368 A | * | 3/1999 | Doell et al. | 313/637 |
| 6,069,456 A | | 5/2000 | Fromm et al. | |
| 6,483,241 B1 | * | 11/2002 | Stockwald | 313/638 |
| 6,603,267 B2 | | 8/2003 | Hilbig et al. | |
| 2002/0047525 A1 | | 4/2002 | Scholl et al. | |

FOREIGN PATENT DOCUMENTS

| | | |
|---|---|---|
| EP | 0407160 | 1/1991 |
| GB | 1502612 | 3/1978 |
| RU | 2027248 | 1/1995 |
| WO | WO2004025688 | 3/2004 |
| WO | WO2004049387 | 6/2004 |

* cited by examiner

*Primary Examiner*—Toan Ton
*Assistant Examiner*—Britt D Hanley
(74) *Attorney, Agent, or Firm*—Fletcher Yoder

(57) ABSTRACT

A mercury-free discharge composition is provided. The mercury-free discharge composition may include Titanium, Zirconium, Hafnium, or combinations thereof, and a halogen. The composition may be capable of emitting radiation if excited, and the composition may produce a total equilibrium operating pressure of less than about 100,000 pascals if excited. A mercury-free discharge lamp is also provided. The mercury-free discharge lamp may include an envelope; an ionizable discharge composition including Titanium, Zirconium, Hafnium, or a combination thereof applied within the envelope.

23 Claims, 9 Drawing Sheets

MERCURY-FREE DISCHARGE COMPOSITIONS AND LAMPS INCORPORATING TITANIUM, ZIRCONIUM, AND HAFNIUM

CROSS REFERENCE TO RELATED APPLICATIONS

This application is a continuation in part of U.S. patent application Ser. No. 11/015,636, entitled "MERCURY-FREE AND SODIUM-FREE COMPOSITIONS AND RADIATION SOURCES INCORPORATING SAME", filed on Dec. 20, 2004, which is herein incorporated by reference.

BACKGROUND

Ionizable discharge compositions may be used in discharge sources such as a discharge lamp. In a discharge lamp, radiation may be produced by an electric discharge in a discharge medium. Typically, the discharge medium may be in a gas or a vapor phase and may be contained by an envelope capable of transmitting the generated radiation out of the envelope. The discharge medium may be excited and ionized through application of an electric field across a pair of electrodes placed within the envelope and in contact with the medium. As the excited atoms and molecules relax to a lower energy state, they emit radiation. Most of the currently used discharge radiation sources contain mercury as a component of the ionizable discharge medium due to its efficient discharge characteristics. Disposal of such mercury-containing radiation sources may be potentially harmful to the environment.

BRIEF DESCRIPTION

In one embodiment of the invention, an ionizable mercury-free discharge composition (hereinafter "mercury-free discharge composition") is provided. The mercury-free discharge composition may include Titanium, Zirconium, Hafnium, or combinations thereof, and a halogen. The composition may be capable of emitting radiation if excited, and the composition may produce a total equilibrium operating pressure of less than about 100,000 pascals if excited.

In another embodiment of the invention, a mercury-free discharge lamp may be provided. The mercury-free discharge lamp may include an envelope; an ionizable discharge composition including Titanium, Zirconium, Hafnium, or a combination thereof applied on the envelope. In another embodiment, a phosphor composition also may be contained by the envelope and in communication with the ionizable discharge composition.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
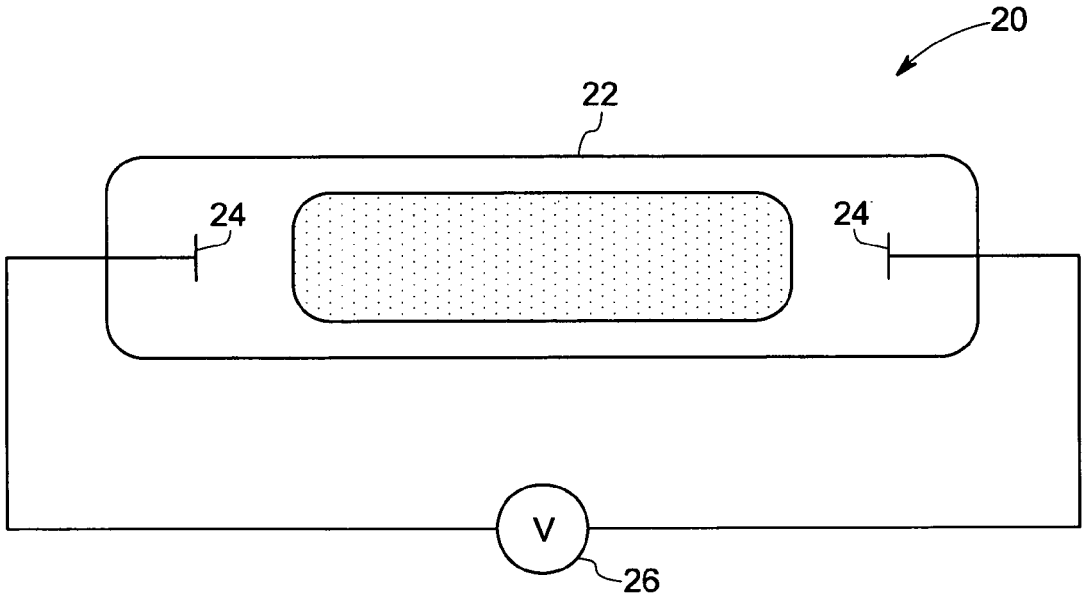
FIG. 1 is a mercury-free discharge lamp according to one embodiment of the present invention.

As discussed in detail below, embodiments of the present invention include mercury-free discharge compositions and radiation sources that incorporate such compositions.

As used herein, the term 'phosphor composition' may simply refer to a single phosphor or may refer to a blend of phosphors or to a blend of materials including at least one phosphor. Furthermore, the terms 'discharge lamp' and 'radiation source' may be used interchangeably herein. The radiation source may include a fluorescent lamp, an excimer lamp, a flat fluorescent lamp, a miniature gas laser or the like.

Mercury-based ionizable discharge compositions are extensively used in radiation sources such as discharge lamps due to the high efficiency of the discharge compositions in generating radiation. However, due to potential health concerns associated with mercury exposure, increasing efforts have been directed towards development of mercury-free discharge compositions. More specifically, research efforts have focused on identification and development of a mercury-free discharge composition having an equally efficient or more efficient discharge as compared to that of mercury-containing compositions. However, finding a mercury-free discharge composition with good efficiency has proven to be a very challenging task. In accordance with aspects of the present invention, it has been determined that Titanium, Zirconium or Hafnium based ionization compositions show good efficiency and are suitable for use as a mercury-free discharge composition in radiation sources. The details of such mercury-free discharge compositions, and optimization details are described in the subsequent embodiments.

In accordance with one aspect of the invention, a mercury-free discharge composition capable of emitting radiation when excited is provided. In one embodiment, the mercury-free discharge composition may include Titanium, Zirconium or Hafnium, or a combination thereof and a halogen. The halogen may include chlorine, bromine, iodine, or combinations of these materials. Accordingly, in one embodiment, the mercury-free discharge composition may include Zirconium iodide. In another embodiment, the mercury-free discharge composition may include Zirconium chloride, while in yet another embodiment, the mercury-free discharge composition may include Zirconium bromide. In one embodiment, the mercury-free discharge composition may include a mixture of two or more of Zirconium halides, or a mixture of elemental Zirconium and a Zirconium halide. Titanium, Zirconium, Hafnium and halogen may be present along with any other element or compound other than mercury and mercury containing compounds. In one embodiment, the ionizable mercury-free discharge composition may be sodium-free.

As mentioned above, the mercury-free discharge composition may be capable of emitting radiation when excited. Upon excitation, the mercury-free discharge material may dissociate and form into different species depending on the energy available for the reactions. The different species may include ions, atoms, electrons, molecules or any other free radicals. At any given instant during discharge, the discharge composition may be a combination of these species. For example, in a mercury-free discharge composition including Zirconium and iodine, upon excitation, the discharge composition may include a mixture of metallic Zirconium, Zirconium ions, iodide ions, various neutral and charged species consisting of Zirconium and Iodine, electrons, and various combinations of these species. The amount of each of these species may depend on the amount of discharge material, internal pressure, and temperature during operation. These dissociation/formation reactions may be reversible and may occur constantly or otherwise repeatedly under steady state conditions. Thus the emission spectra from the emitted radiation of the mercury-free discharge composition may be tuned and hence optimized for increased efficiency by changing one or more characteristics of the discharge lamp. For example, the amount of discharge material introduced into the envelope could be changed, the pressure within the discharge envelope could be changed, and the temperature of the discharge composition during discharge could be changed. Apart from these parameters, various other factors such as the current density, lamp diameter and length, getters, complexing additives, and other parameters may be tuned to optimize the efficiency of the discharge.

The mercury-free discharge composition may further include an inert buffer gas. The inert buffer gas may include helium, neon, argon, krypton, xenon, or combinations thereof. The inert buffer gas may enable or otherwise facilitate the gas discharge to be more readily ignited. The inert buffer gas may also control the steady state operation of the radiation source, and may further be used to optimize operation of the radiation source. In a non-limiting example, argon may be used as the inert buffer gas. However, argon may be substituted or supplemented with one or more other inert gasses, such as helium, neon, krypton, xenon, or combinations thereof.

In one embodiment, the mercury-free discharge composition may produce a total equilibrium operating pressure of less than about 100,000 Pascals when excited. In another embodiment, the composition may produce a total equilibrium operating pressure of less than about 10,000 Pascals when excited. In yet another embodiment, the composition may produce a total equilibrium operating pressure of less than about 2000 Pascals when excited. In one embodiment, the mercury-free discharge lamp has a total equilibrium operating pressure in the range of about 700 Pascals to about 1400 Pascals. In another embodiment, the mercury-free discharge lamp has a total equilibrium operating pressure of about 1000 Pascals.

As noted above, optimizing the discharge composition through e.g., adjustment of the internal pressure of the discharge envelope, the amount of discharge material within the envelope, and temperature of the discharge composition may improve the efficiency of discharge radiation during operation. Such optimization may be effected by controlling the partial pressure of Titanium, Zirconium, Hafnium, or a combination thereof and their compounds present within the discharge composition such, or by controlling the pressure of the inert buffer gas, or both together. Moreover, it has been determined that an increase in the luminous efficacy of a device incorporating the mercury-free discharge composition described herein may be achieved by controlling the operating temperature of the discharge. The luminous efficacy, expressed in lumen/Watt, is the ratio between the brightness of the radiation in a specific visible wavelength range and the energy used to generate the radiation.

In accordance with another aspect of the invention, a mercury-free discharge lamp is provided. The mercury-free discharge lamp may include, an envelope, an ionizable discharge composition including Titanium, Zirconium, Hafnium or a combination thereof, contained by the envelope, and sometimes a phosphor composition contained by the envelope and in communication with the ionizable discharge composition. FIG. 1 schematically illustrates one such mercury-free is charge lamp 20. FIG. 1 shows a tubular vessel or envelope 22 containing an ionizable mercury-free discharge composition according to one embodiment of the invention. The envelope 22 may be transparent, semi-transparent, or opaque. In one embodiment, the envelope 22 may be a substantially transparent material. The term "substantially transparent" means allowing a total transmission of at least about 50 percent, preferably at least about 75 percent, and more preferably at least about 90 percent, of the incident radiation within about 10 degrees of a perpendicular to a tangent drawn at any point on the surface of the envelope. The envelope 22 may have a circular or a non-circular cross section, and need not be straight.

In one embodiment, the discharge may be desirably excited by a plurality of thermionically emitting electrodes 24 connected to a voltage source 26. The discharge may also be generated by other methods of excitation that provide energy to the composition such as capacitive coupling. Various waveforms of voltage and current, including alternating or direct, are contemplated for use in providing excitation to the discharge medium. Additional voltage sources may also be present to help maintain the electrodes at a temperature sufficient for thermionic emission of electrons. Additionally, a phosphor composition may be coated on the inner surface of the envelope 22. Alternatively, the phosphor composition may be applied to the outside of the radiation source envelope provided that the envelope is not made of any material that absorbs a significant amount of the radiation emitted by the discharge. A suitable material for this embodiment is quartz, which absorbs little radiation in the UV spectrum range. Another embodiment of this invention may have a special glass as the suitable material. The phosphor layer coatings in discharge lamps may be formed by various procedures including deposition from liquid suspensions and electrostatic deposition. For example, the phosphor may be deposited on the envelope surface from an aqueous suspension including various organic binders and adhesion promoting agents. The aqueous suspension may be applied and then dried.

Figure 2:
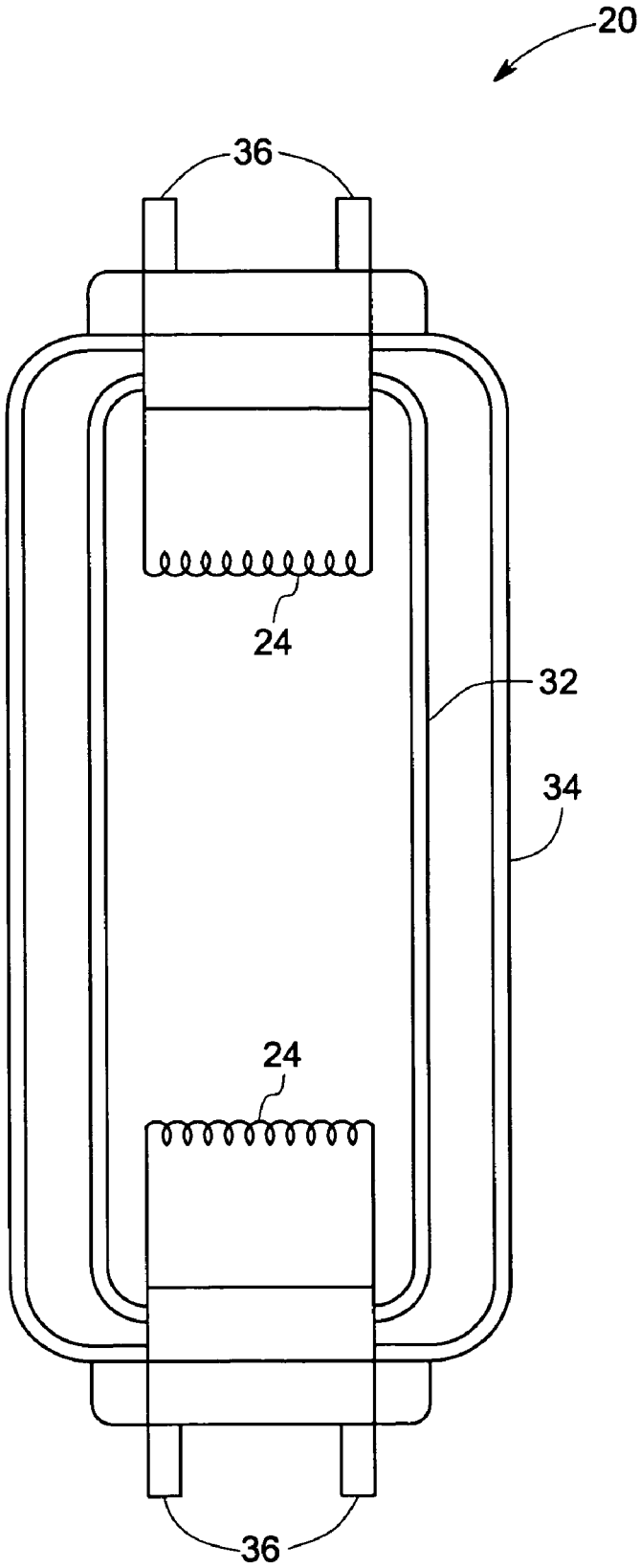
FIG. 2 is a mercury-free discharge lamp according to another embodiment of the present invention.

FIG. 2 schematically illustrates another embodiment of a mercury-free discharge lamp 20. The envelope may include an inner envelope 32 and an outer envelope 34. The mercury-free discharge lamp 20 may be connected to an external voltage source through a set of external electrodes or external electrical connections to the electrodes 36. The space between the two envelopes may be either evacuated or filled with a gas. In such embodiments a phosphor composition may be coated on the outer surface of the inner envelope and/or the inner surface of the outer envelope. The evacuated space between the envelopes may ensure that the phosphor composition is not exposed to high temperature during operation. The illustrated double walled envelope may be used to thermally insulate the inner tube to allow it to reach the desired operating temperature in instances where the input power density is insufficient to heat the wall to the desired operating temperature in the ambient. An infrared reflecting coating such as indium-tin-oxide can be coated onto the inner surface of the outer envelope, to further raise the temperature of the inner envelope.

Figure 3:
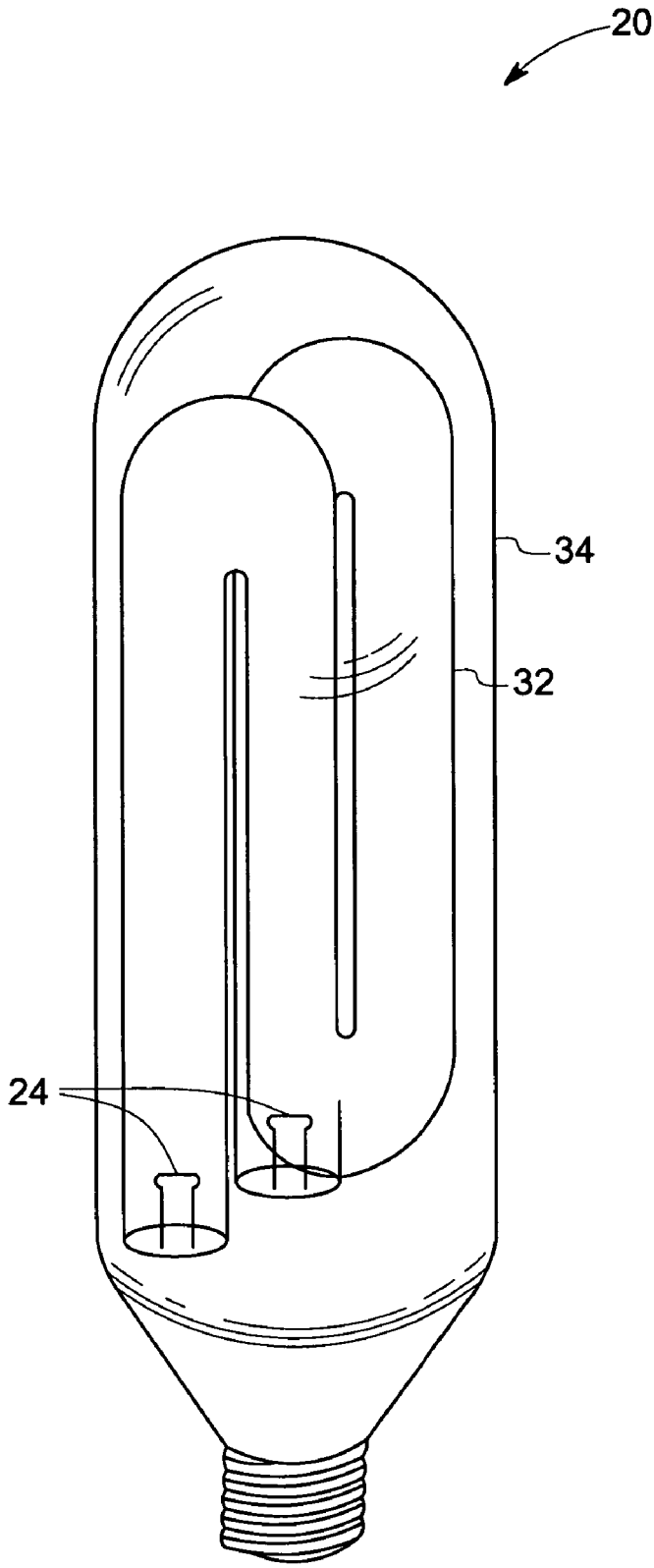
FIG. 3 is a mercury-free discharge lamp according to yet another embodiment of the radiation source of the present invention.

The mercury-free discharge lamp envelope may alternatively be embodied so as to be a multiple-bent tube with inner envelope 32 surrounded by an outer envelope or bulb 34 as shown in FIG. 3. The lamp configuration may have a form factor of a compact fluorescent lamp and may be chosen for realizing a low temperature operation of the lamp in order to minimize the color change that may occur due to heating of the phosphor composition.

In accordance with one aspect of the present invention, a discharge lamp is provided with a discharge mechanism configured to generate and maintain a gas discharge. For example, the discharge lamp may include electrodes disposed at two points of a discharge lamp housing or envelope and a current source providing a current to the electrodes. In one embodiment, the electrodes may be hermetically sealed within the envelope. In another embodiment, the discharge lamp may be electrodeless. In another embodiment of an electrodeless discharge lamp, the discharge mechanism includes an emitter of electromagnetic radiation present outside or inside the envelope containing the ionizable composition In still another embodiment of the present invention, the ionizable composition is capacitively excited with a high frequency field, the electrodes being provided on the outside of the gas discharge vessel. In still another embodiment of the present invention, the ionizable composition is inductively excited using a high frequency field.

Mercury-free metal halide based discharge compositions described herein have spectral transitions at different wavelengths than that of the mercury-based discharge compositions. In accordance with another aspect of the invention, phosphor compositions are provided that are suitable for use in radiation sources such as a discharge lamp incorporating the ionizable mercury-free metal halide discharge composition described herein. In one embodiment, the phosphor compositions may be placed in communication with the discharge composition to absorb at least a portion of the radiation emitted by the discharge composition at one wavelength and to emit radiation of a different wavelength. The chemical composition of the phosphor may determine the spectrum of the radiation emitted. In particular, a phosphor composition used in a discharge lamp incorporating the metal halide discharge composition may be configured to absorb radiation in the UV and visible ranges and emit in the visible wavelength ranges, such as in the red, blue and green wavelength range, and enable a high fluorescence quantum yield to be achieved. In one embodiment, a phosphor composition may be configures to absorb radiation in IR and emit in the visible ranges.

Figure 4:
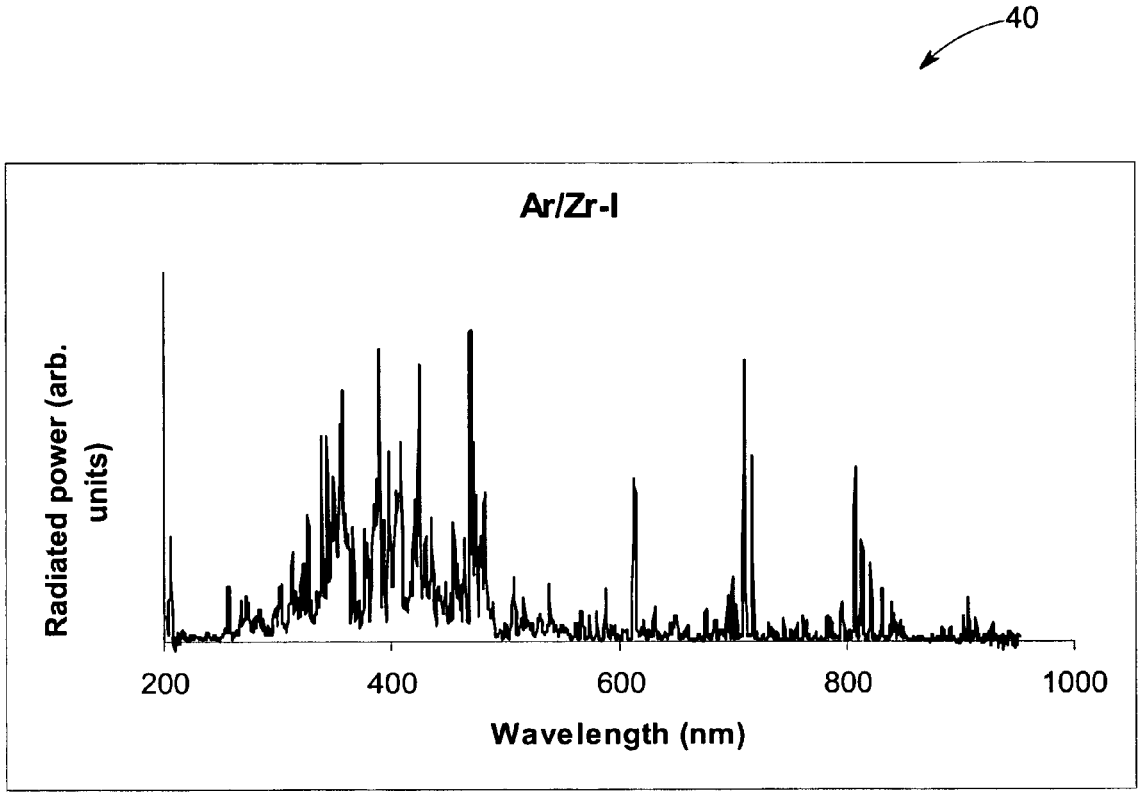
FIG. 4 is an emission spectrum of a mercury-free discharge composition according to one embodiment of the present invention.
Figure 5:
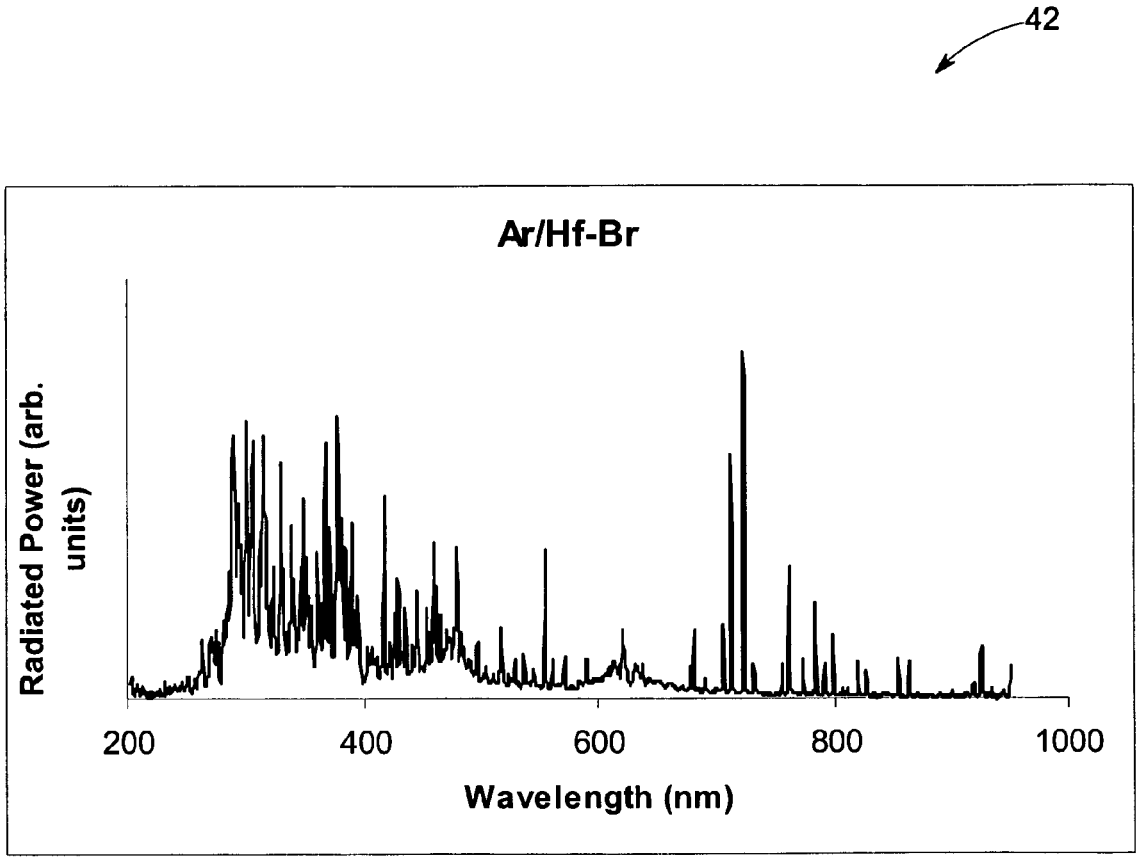
FIG. 5 is an emission spectrum of a mercury-free discharge composition according to another embodiment of the present invention.

For example, in a gas discharge radiation source including Zirconium iodide based discharge composition, the radiation output is composed of multiple spectral transitions in the UV region between about 200 nanometers to about 400 nanometers, and in the IR region between about 700 nanometers to about 1000 nanometers, in addition to the band in the visible region between about 400 nanometers to about 700 nanometers, as shown in the emission spectra 40 of FIG. 4. A similar situation exists in the case of Titanium Iodide and Hafnium Bromide based discharge compositions, other embodiments of this invention (See FIGS. 6 and 7, respectively)

Figure 6:
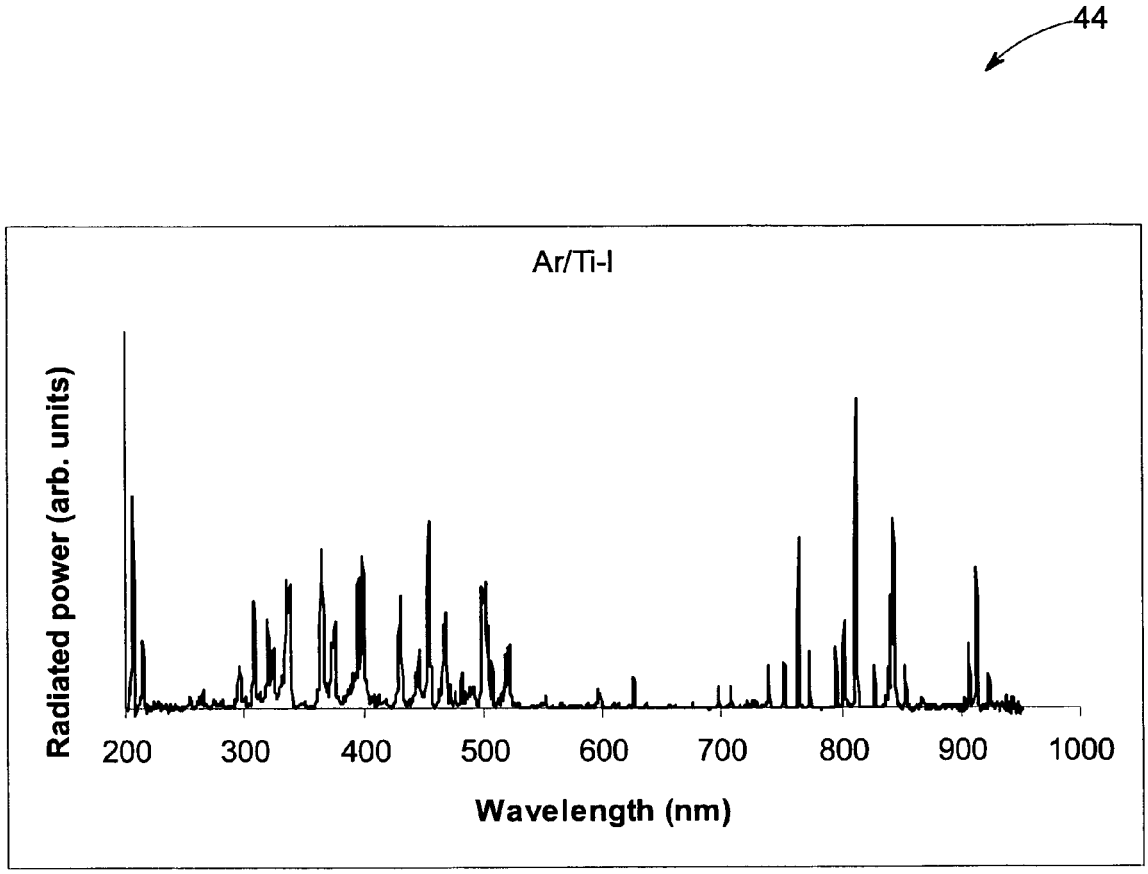
FIG. 6 is an emission spectrum of a mercury-free discharge composition according to yet another embodiment of the present invention.
Figure 7:
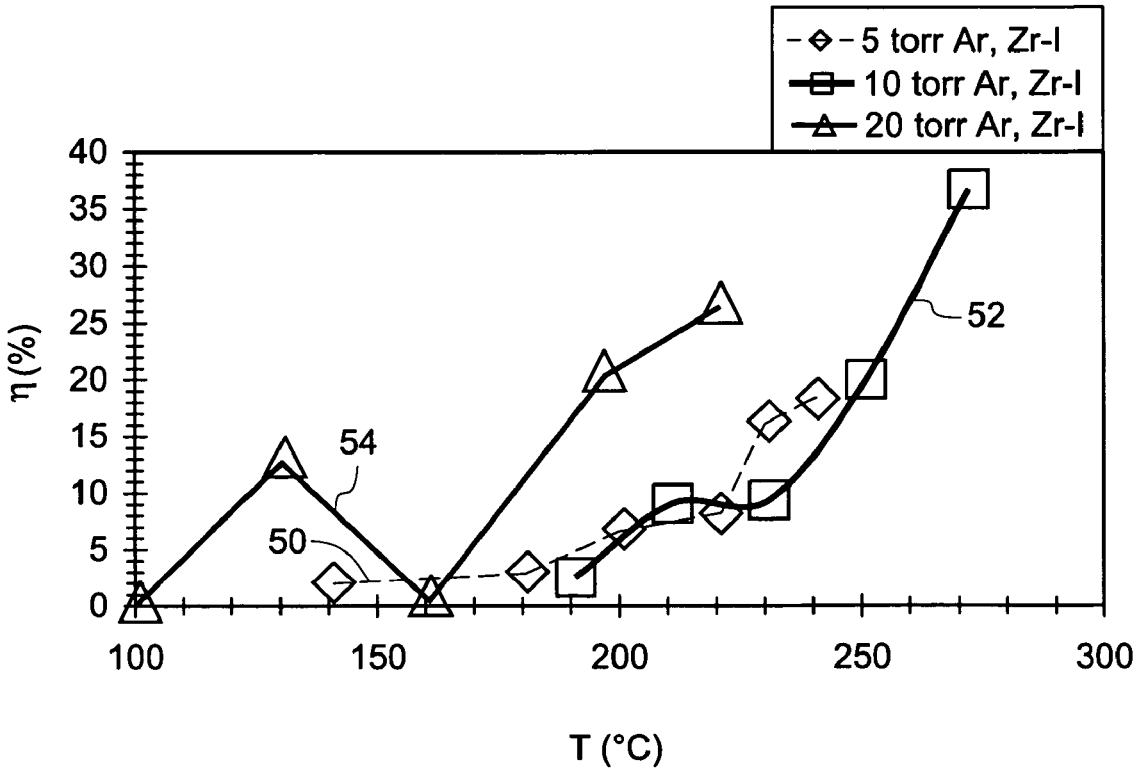
FIG. 7 is a plot of discharge efficiency versus operating temperature for different mercury-free discharge compositions, according to one embodiment of the present invention.

FIG. 6 represents the emission spectra 42 of a discharge composition including Hafnium Bromide, according to another embodiment of the present invention. The radiation output in this case is also composed of multiple transitions in the UV, visible and IR regions. But compared to Zirconium, less power is radiated in the IR region in the case of Hafnium FIG. 7 shows the emission spectra 44 of a discharge composition including Titanium Iodide. In this embodiment of the invention also the power is radiated through multiple transitions. However, in this embodiment, the power radiated in the IR region is more compared to either Zr or Hf based compositions.

In such embodiments, a suitable phosphor that absorbs radiation having at least one of the wavelength regions, V, IR or visible, and emits in the visible spectrum may be used.

In one embodiment of this invention, the discharge composition comprises any of the stable halides of Ti, Zr or Hf, for example, $ZrI_4$, mixed with an amount of the same metal in elemental form, for example Zr, resulting in a Zirconium to Iodine molar ratio of less than the stable ratio (1:4) in this case.

In another embodiment, the discharge composition comprises a mixture of elemental metals comprising Titanium, Zirconium, Hafnium, or combinations thereof, and an elemental halogen.

Figure 8:
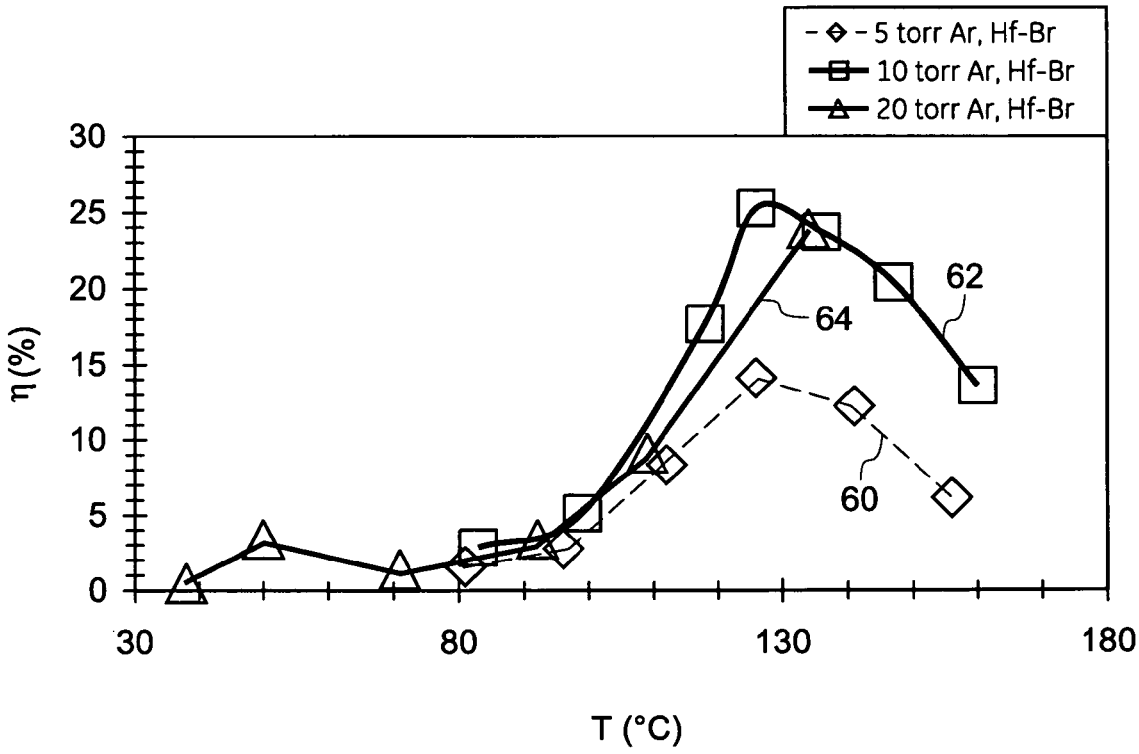
FIG. 8 is a plot of discharge efficiency versus operating temperature for different mercury-free discharge compositions, according to another embodiment of the present invention.

FIGS. 7 and 8 illustrate plots of variation of efficiency for different Zirconium and Hafnium halide based compositions respectively plotted versus temperature according to various embodiments of the invention. In FIG. 7, the efficiencies have been plotted at three equilibrium operating pressures—at about 5 torr (about 350 pascals) 50, about 10 torr (about 700 pascals) 52, and about 20 torr (1400 pascals) 54. The plots indicate that Zirconium Iodide based discharge compositions show high efficiency at temperatures above about 200° C. The data for 700 pascals 52 show the highest efficiency in this case.

FIG. 8 illustrates the efficiencies for a discharge composition comprising Hafnium Bromide, according to another embodiment of the present invention. The data is for three different equilibrium operating pressures—at about 5 torr (about 350 pascals) 60, about 10 torr (about 700 pascals) 62, and about 20 torr (1400 pascals) 64. The Hafnium Bromide discharge works at peak efficiency at a lower temperature, according to this plot, with the peak efficiency temperatures at around 120-130° C. in each of these cases. The best efficiency within this plot is obtained at about 700 pascals of equilibrium operating pressure 62.

Figure 9:
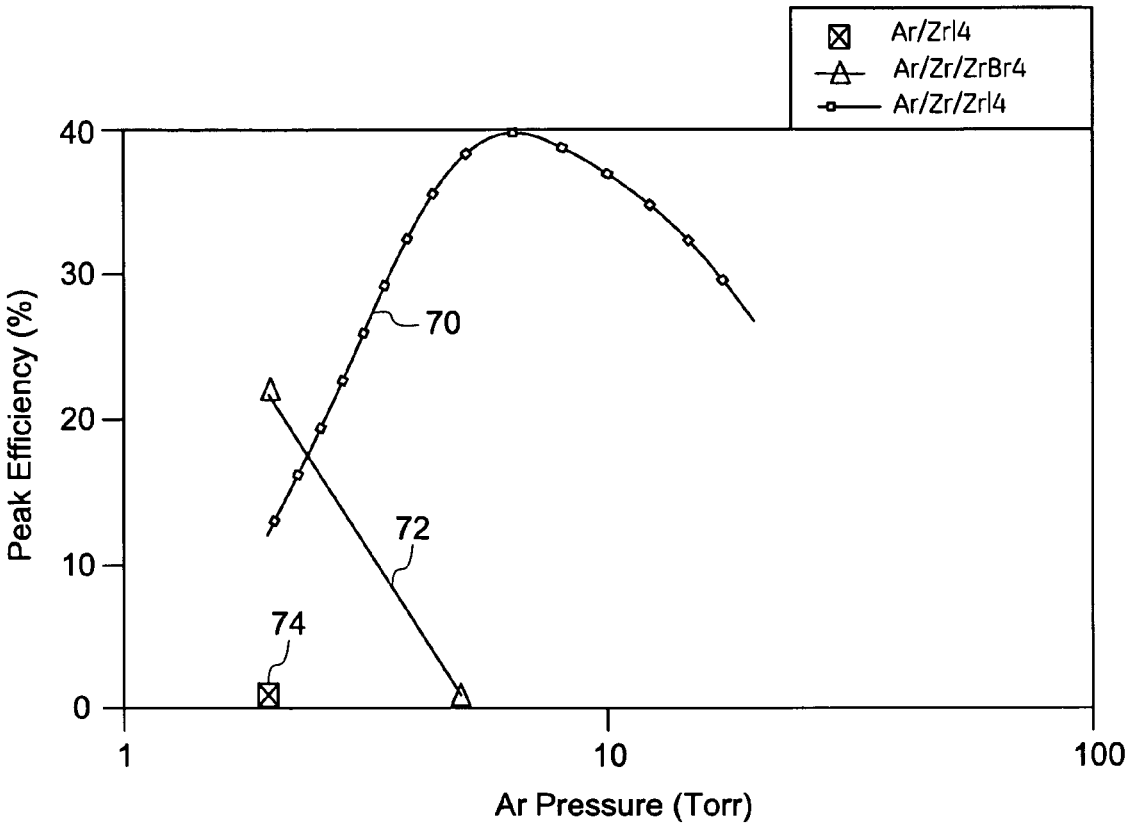
FIG. 9 is a plot of variation of efficiency of different mercury-free discharge compositions with Argon pressures according to one embodiment of the present invention.

FIG. 9 shows the peak efficiencies for different discharge compositions based on various embodiments of this invention. In these embodiments, Argon has been used as the inert gas and the peak efficiencies have been plotted against Argon pressure at peak temperatures of about or above 200° C. The compositions comprise a mixture of Zr and $ZrI_4$ 70, a mixture of Zr and $ZrBr_4$ 72 and $ZrI_4$ only 74. It is clear from the plot that peak efficiencies vary as a function of Argon pressure for many discharge compositions. For example, the best peak efficiency for a composition comprising a mixture of Zr and $ZrI_4$ 70 occurs at a range between about 5 torr (about 700 pascals) and about 10 torr (about 1400 pascals), more specifically, at about 7 torr (about 1000 Pascals).

In one embodiment, a phosphor composition used in a discharge lamp incorporating the metal halide discharge composition may include a phosphor blend of at least one red emitting phosphor, a green emitting phosphor, and a blue emitting phosphor. When the phosphor composition includes a blend of two or more phosphors, the ratio of each of the individual phosphors in the phosphor blend may vary depending on the characteristics of the desired light output. The composition and the ratio of the red, green, and blue emitting phosphors may be chosen to obtain maximum light output at the desired wavelength range, high temperature stability, and high color rendition. The relative proportions of the individual phosphors in the various embodiment phosphor blends may be adjusted such that their emissions are blended to give a desired color. In one embodiment, the blend is chosen to produce a white light. Color rendition or color rendering index ("CRI") is a measure of the degree of distortion in the apparent colors of a set of standard pigments when measured with the light source in question as opposed to a standard light source. CRI depends on the spectral energy distribution of the emitted light and can be determined by calculating the color shift; e.g., quantified as tristimulus values, produced by the light source in question as opposed to the standard light source. Under illumination with a lamp with low CRI, an object does not appear natural to the human eye. Thus, the better lamp sources have CRI close to 100.

In one embodiment, the phosphor composition used in the discharge lamp may include a phosphor blend of at least one phosphor that absorbs in UV.

Example 1

A cylindrical quartz/vitreous silica discharge envelope, which is transparent to UV-A radiation (radiation having wavelength in the range of 200-400 nm), having a length of about 35 cm, and a diameter of about 2.5 cm, was provided. The discharge envelope was evacuated and a dose of about 3.6 mg Zr and about 7.7 mg $ZrI_4$, and argon were added. The pressure of argon was about 670 Pa at ambient temperature. The envelope was inserted into a furnace and power was capacitively coupled into the gas medium via external gold-coated copper electrodes at an excitation frequency of about 13.56 MHz. Radiative emission and radiant efficiency were measured. The ultraviolet and visible output power was estimated to be about 38 percent of the input electrical power of 63 W at a temperature of at about 262° C. When the ultraviolet radiation is converted to visible light by a suitable phosphor blend, the luminous efficacy is estimated to be about 80 lumens per Watt. The following table details the measurements done at different temperatures and Argon pressures during this experiment.

Example 2

A cylindrical quartz/vitreous silica discharge envelope, which is transparent to UV-A radiation (radiation having wavelength in the range of 200-400 nm), having a length of about 35 cm, and a diameter of about 2.5 cm, was provided. The discharge envelope was evacuated and a dose of about 4.8 mg Hf and about 5.5 mg HfBr4 and argon were added. The pressure of argon was about 1340 Pa at ambient temperature. The envelope was inserted into a furnace and power was capacitively coupled into the gas medium via external gold-coated copper electrodes at an excitation frequency of about 13.56 MHz. Radiative emission and radiant efficiency were measured. The ultraviolet and visible output power was estimated to be about 25 percent of the input electrical power of 42 W at a temperature of about 126° C. When the ultraviolet radiation is converted to visible light by a suitable phosphor blend, the luminous efficacy is estimated to be about 59 lumens per watt. The following table shows the summary of measurements done during this experiment at different temperatures and Argon pressures.

Example 3

A cylindrical quartz/vitreous silica discharge envelope, which is transparent to UV-A radiation (radiation having wavelength in the range of 200-400 nm), having a length of about 35 cm, and a diameter of about 2.5 cm, was provided. The discharge envelope was evacuated and a dose of about 0.4 mg Ti and about 4.6 mg TiI4 and argon were added. The pressure of argon was about 267 Pa at ambient temperature. The envelope was inserted into a furnace and power was capacitively coupled into the gas medium via external gold-coated copper electrodes at an excitation frequency of about 13.56 MHz. Radiative emission and radiant efficiency were measured. The ultraviolet and visible output power was estimated to be about 15 percent of the input electrical power of 65 W at a temperature of about 137° C. When the ultraviolet radiation is converted to visible light by a suitable phosphor blend, the luminous efficacy is estimated to be about 39 lumens per watt.

The efficiencies quoted in the above examples are computed under the assumption that the plasma is diffuse, and that the luminous region fills the tube. In fact, these plasmas appear to be constricted and do not completely fill the radius of the tube. This difference may lead to an overestimate of the efficiency.

While various embodiments are described herein, it will be appreciated from the specification that various combinations of elements, variations, equivalents, or improvements therein are foreseeable, may be made by those skilled in the art, and are still within the scope of the invention as defined in the appended claims.

What is claimed is:

1. A mercury-free discharge lamp, comprising:

an envelope; and an inert buffer gas disposed in the envelope;

an ionizable discharge composition disposed in the envelope, wherein the ionizable discharge composition comprises:

a metal halide comprising Titanium, Zirconium, or Hafnium, or a combination thereof, and a halide; and an elemental metal comprising Titanium, Zirconium, or Hafnium, or a combination thereof, wherein the mercury-free discharge lamp has a total equilibrium operating pressure of less than about 100000 pascals.

2. The mercury-free discharge lamp of claim 1, wherein the mercury-free discharge lamp has a total equilibrium operating pressure of less than about 10000 pascals.

3. The mercury-free discharge lamp of claim 1, comprising a phosphor composition disposed on the envelope.

4. The mercury-free discharge lamp of claim 1, wherein the metal halide comprises a Zirconium halide.

5. The mercury-free discharge lamp of claim 1, wherein the metal halide comprises a Hafnium halide.

6. The mercury-free discharge lamp of claim 1, wherein the metal halide comprises a Titanium halide.

7. The mercury-free discharge lamp of claim 1, wherein the ionizable discharge composition is sodium free.

8. The mercury-free discharge lamp of claim 1, wherein a molar ratio of the Titanium, the Zirconium, or the Hafnium to the halide in the ionizable discharge composition is more than about 1:4.

9. The mercury-free discharge lamp of claim 1, wherein the halide comprises chloride, bromide, or iodide, or a combination thereof.

10. The mercury-free discharge lamp of claim 1, wherein the inert buffer gas comprises helium, neon, argon, krypton, or xenon, or a combination thereof.

11. The mercury-free discharge lamp of claim 1, wherein the inert buffer gas comprises argon.

12. A mercury-free discharge lamp comprising:

an envelope;

an inert buffer gas disposed in the envelope; and an ionizable discharge composition disposed in the envelope, wherein the ionizable discharge composition comprises a Zirconium halide and elemental Zirconium, and a molar ratio of Zirconium to halogen is in the range of about 1:0 to less than 1:4.

13. The mercury-free discharge lamp of claim 12, wherein the halogen comprises chlorine, bromine, or iodine, or a combination thereof.

14. The mercury-free discharge lamp of claim 12, wherein a total equilibrium operating pressure is less than about 100000 pascals.

15. The mercury-free discharge lamp of claim 12, wherein a total equilibrium operating pressure is less than about 10000 pascals.

16. The mercury-free discharge lamp of claim 12, wherein a total equilibrium operating pressure is between about 700 pascals and about 1400 pascals.

17. The mercury-free discharge lamp of claim 12, wherein the inert buffer gas comprises helium, neon, argon, krypton, or xenon, or a combination thereof.

18. The mercury-free discharge lamp of claim 12, wherein the inert buffer gas comprises argon.

19. An ionizable mercury-free discharge composition, comprising:

an inert buffer gas;

a Titanium halide, a Zirconium halide, or a Hafnium halide, or a combination thereof; and elemental Titanium, elemental Zirconium, elemental Hafnium, or a combination thereof, wherein the composition is configured to emit radiation upon excitation, and the composition is configured to produce a total operating pressure of less than about 100000 pascals.

20. The ionizable mercury-free discharge composition of claim 19, wherein the composition comprises the Titanium halide and the elemental Titanium.

21. The ionizable mercury-free discharge composition of claim 19, wherein the composition comprises the Zirconium halide and the elemental Zirconium.

22. The ionizable mercury-free discharge composition of claim 19, wherein the composition comprises the Hafnium halide and the elemental Hafnium.

23. The ionizable mercury-free discharge composition of claim 19, wherein a molar ratio of Zirconium to halogen is in the range of about 1:0 to less than 1:4.

* * * * *